US012116765B2

(12) United States Patent
Erickson

(10) Patent No.: US 12,116,765 B2
(45) Date of Patent: Oct. 15, 2024

(54) AUTOMATED TOILET BOWL CLEANER

(71) Applicant: Carson Erickson, Port Charlotte, FL (US)

(72) Inventor: Carson Erickson, Port Charlotte, FL (US)

( * ) Notice: Subject to any disclaimer, the term of this patent is extended or adjusted under 35 U.S.C. 154(b) by 214 days.

(21) Appl. No.: 17/807,504

(22) Filed: Jun. 17, 2022

(65) Prior Publication Data

US 2022/0403638 A1 Dec. 22, 2022

Related U.S. Application Data

(60) Provisional application No. 63/211,923, filed on Jun. 17, 2021.

(51) Int. Cl.
*E03D 9/00* (2006.01)
*A46B 13/02* (2006.01)

(52) U.S. Cl.
CPC ..... *E03D 9/002* (2013.01); *A46B 13/02* (2013.01)

(58) Field of Classification Search
CPC ..... E03D 9/002; A46B 13/02; A47K 13/30; A47K 13/302
USPC ..... 4/662, 233, 222, 227.1; 15/246
See application file for complete search history.

(56) References Cited

U.S. PATENT DOCUMENTS

| | | | | |
|---|---|---|---|---|
| 2,929,073 | A | 3/1960 | Sarlin | |
| 3,599,246 | A | 8/1971 | Bramati et al. | |
| 3,815,158 | A | 6/1974 | Schnyder et al. | |
| 3,837,018 | A | 9/1974 | Haberle | |
| 4,217,671 | A | 8/1980 | Rand | |
| 5,504,946 | A * | 4/1996 | Keshiro | A47K 13/302 4/233 |
| 7,832,030 | B2 | 11/2010 | Nunez et al. | |
| 8,011,051 | B1 | 9/2011 | Ba-Akeel et al. | |
| 8,616,796 | B2 | 12/2013 | Lobl | |
| 9,297,155 | B2 | 3/2016 | Ralea | |
| 9,644,358 | B2 | 5/2017 | Qualls et al. | |
| 9,943,197 | B2 | 4/2018 | Shabat | |
| 10,941,555 | B2 | 3/2021 | DSouza et al. | |
| 2006/0021121 | A1 | 2/2006 | Moussa | |
| 2006/0123529 | A1 | 6/2006 | Conway et al. | |
| 2007/0214566 | A1 | 9/2007 | Blevins | |
| 2010/0257662 | A1 * | 10/2010 | Huang | A47K 13/302 4/223 |
| 2016/0059269 | A1 | 3/2016 | Ronding | |
| 2018/0216330 | A1 | 8/2018 | Tokarev et al. | |
| 2020/0063423 | A1 | 2/2020 | Bruno | |
| 2020/0109545 | A1 | 4/2020 | Ben Amram | |

FOREIGN PATENT DOCUMENTS

CN 107326993 A * 11/2017 ..... E03D 9/002

* cited by examiner

*Primary Examiner* — Tuan N Nguyen
(74) *Attorney, Agent, or Firm* — Dunlap Bennett & Ludwig, PLLC

(57) ABSTRACT

A toilet bowl cleaning device including a toilet bowl lid housing a motor and a plurality of releasably secured scrub brushes, each attached to an interior face of the toilet bowl lid by connection rod and by a detachable and rotatable connection piece. The motor rotates the scrub brush, and the scrub brush scrubs an interior of the toilet bowl.

3 Claims, 8 Drawing Sheets

AUTOMATED TOILET BOWL CLEANER

CROSS-REFERENCE TO RELATED APPLICATION

This application claims the benefit of priority of U.S. provisional application No. 63/211,923, filed Jun. 17, 2021 the contents of which are herein incorporated by reference.

BACKGROUND OF THE INVENTION

The present invention relates to toilet bowl cleaners and, more particularly, to automatic toilet bowl cleaners.

To keep a toilet bowl sanitized and clean, manual scrubbing is required on a regular and frequent basis. Tough water stains, rust, and neglect accumulate, requiring hands on, hand in scrubbing with close contact with germs and odor. This unpleasant and manual process can promote an unhealthy buildup of germs. In addition, traditional cleaning requires chemical cleaners, rubber gloves, and manual scrubbing.

Automation speeds up the process and eliminates the manual and unpleasant nature encountered when cleaning a toilet bowl. However, currently available automated toilet bowl scrubbers are inefficient, ineffective, and too expensive.

As can be seen, there is a need for an automated toilet bowl cleaner that prevents a user from engaging in scrubbing and close contact with odor and germs that is more efficient, effective, and less expensive.

SUMMARY OF THE INVENTION

In one aspect of the present invention, a toilet bowl cleaning device comprises a toilet bowl lid housing a motor and a plurality of releasably secured scrub brushes, each attached to an interior face of the toilet bowl lid by connection rod and a detachable and rotatable connection piece wherein the motor rotates the scrub brush, and the scrub brush scrubs an interior of the toilet bowl.

In another aspect of the present invention, a toilet bowl lid for cleaning a toilet comprising a motor housed within the toilet bowl lid, a left brush guide and a right brush guide on an interior face of the toilet bowl lid, and a left scrubbing brush releasably secured within the left brush guide and a right scrubbing brush releasably secured within the right brush guide, wherein the motor simultaneously rotates the left scrubbing brush and the right scrubbing brush, and the left scrubbing brush and the right scrubbing brush simultaneously traverse the left brush guide and the right brush guide, respectively.

In another aspect of the present invention, a toilet bowl lid for cleaning a toilet comprising a drive shaft vertically traversing an interior face of the toilet bowl lid, a drive motor secured to the drive shaft wherein the drive motor may vertically travel the drive shaft, a first drive brush shaft attached to the drive motor and a second drive brush shaft attached to the drive motor, the first drive brush shaft configured to vertically traverse a left brush guide, the second drive brush shaft configured to vertically traverse a right brush guide, a left scrub brush releasably secured to the first drive brush shaft, and a right scrub brush releasably secured to the second drive brush shaft, wherein the drive motor simultaneously rotates the first scrub brush and the second scrub brush while simultaneously causing the first drive brush shaft to traverse the left brush guide and the second drive brush shaft to traverse the right brush guide.

These and other features, aspects and advantages of the present invention will become better understood with reference to the following drawings, description, and claims.

DETAILED DESCRIPTION OF THE INVENTION

Figure 1:
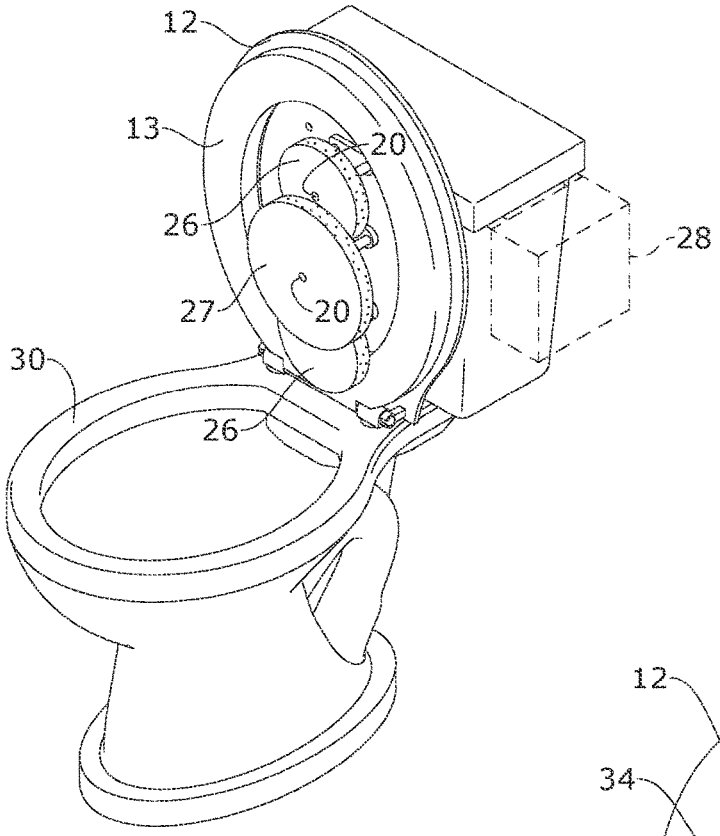
FIG. 1 is a perspective view of an automated toilet bowl cleaner according to an embodiment of the present invention.
Figure 2:
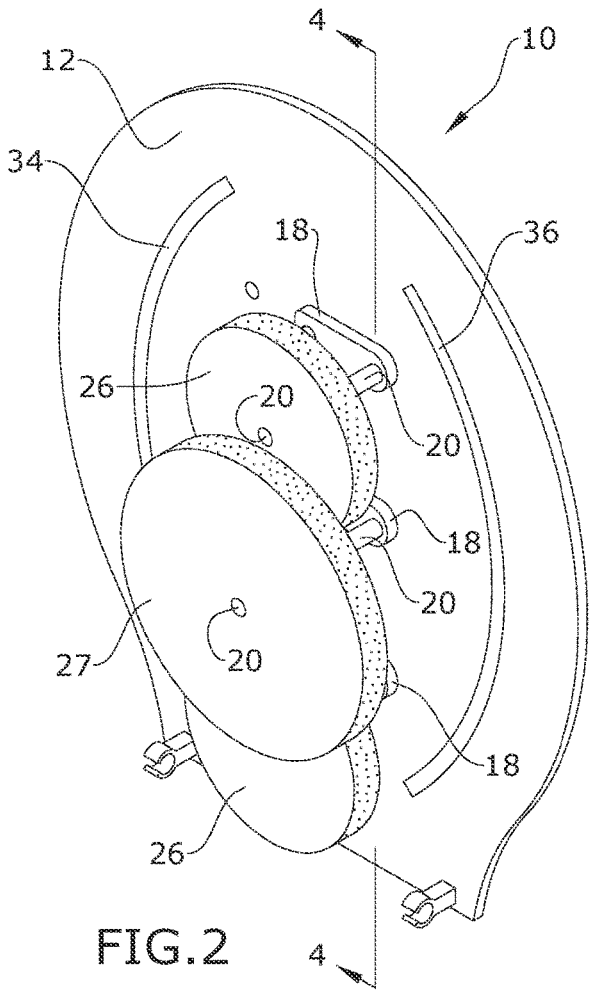
FIG. 2 is a perspective view of a toilet bowl lid thereof.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims with reference to the drawings.

A general overview of the various features of the invention will be provided, with a detailed description following. Broadly, an embodiment of the present invention provides a mechanical toilet cleaning device, eliminating hands on and hand in the bowl scrubbing. The mechanical invention eliminates close contact to germs and odor associated with bathroom toilet bowls. The device may be set up and ready for operation within seconds. Stains from tough water, rust, and from neglect may be cleaned mechanically with no extra chemical cleaners or rubber gloves needed.

The present invention may comprise a toilet bowl lid that houses a motor, such as a standard kitchen mixer motor, and ports configured to receive brushes. The motor may be alternating current or direct current and spin the brushes. The motor may drive or rotate scrub brushes, causing them to scrub an interior of the toilet bowl.

In some embodiments of the present invention, the toilet bowel lid may comprise a left brush guide and a right brush guide, or alternatively a first brush guide and a second brush guide, on an interior face of the toilet bowl lid. The brush guides may be apertures vertically, or substantially vertically, traversing the interior face of the toilet bowl lid.

A left scrub brush may fit into the left brush guide. A right scrub brush may fit into the right brush guide. Alternatively, the left scrub brush and right scrub brush may be referred to as a first scrub brush and a second scrub brush, respectively. The scrubbing brushes may be releasably secured within their respective guides. The motor may drive or cause the left scrub brush and right scrub brush to simultaneously travel the left brush guide and right brush guide, respectively. The scrub brushes may also rotate within their respective guide while traveling or traversing the guide. The motor may drive these actions simultaneously. This enables the scrub brushes to clean a larger area of the interior of the toilet bowl.

The lid may further comprise a removable cover on its exterior. A user may remove the cover to access mechanical parts housed within the lid.

The brushes may be specifically adapted for use with the present invention. Alternatively, the brush may be a standard toilet brush.

The lid may further include anchors to hold or assist in holding the motor in place.

The present invention may further comprise a rack for storage of the brushes. The rack may be situated inside of the toilet tank. When cleaning is complete, a user may un-attach the brushes from the ports and store them in the rack.

An external storage box may also attach to the toilet tank. The external box may accommodate a disinfectant and dispense the disinfectant into the toilet tank.

The present invention may be purchased as a fully assembled kit to be installed and replace a user's toilet bowl lid. Alternatively, the present invention may be installed onto an existing toilet bowl lid. When installing, holes may be drilled into the existing toilet bowl lid for the attachment of the motor and scrub brush of the present invention. All pieces for installation may be provided in an installation kit.

The toilet lid may comprise a slide lid cover may be slid off for attachment of cleaning brushes through ports. The slide lid cover may also give a user access to the motor or enable the user to attach a motor. The invention may be activated causing the motor to spin the brushes until a desired cleaning outcome is achieved.

Detachable and rotatable connection pieces may attach scrubbing brushes to the toilet bowl lid. Said detachable and rotatable connection pieces may be detached and removed from the toilet bowl lid, then rotated or flipped, for example to face an opposite direction, and re-attached or resecured to the toilet bowl lid. This enables the scrubbing brush to reach all sides of the toilet bowl.

In some embodiments of the present invention, the brushes may be driven manually by a screwdriver, or the motor may be manually rotated by a screwdriver.

In some embodiments of the present invention, the toilet lid comprises a toilet brush storage compartment. Upon activation of the device, the toilet brush may automatically protrude from the toilet brush storage compartment. The toilet brush may then be driven by the motor to clean the toilet bowl. Upon completion, the toilet brush lid may be automatically concealed within the toilet brush storage compartment.

In some embodiments, the toilet brushes may be manually inserted into the toilet lid. The toilet brushes may then be driven by the motor to clean the toilet bowl. Upon completion, the toilet brushes may be removed by a user and stored in the toilet brush storage compartment.

A user may activate the present invention and leave the room, allowing the invention to clean the toilet without user assistance or supervision.

Referring to the Figures, FIGS. 1-4 depict an automated toilet bowl cleaner 10 according to an embodiment of the present invention. The toilet 30 includes a toilet lid 12, a toilet seat 13, and a disinfectant storage box 28. The toilet lid 12 includes a left brush guide 34 and a right brush guide 36.

Figure 3:
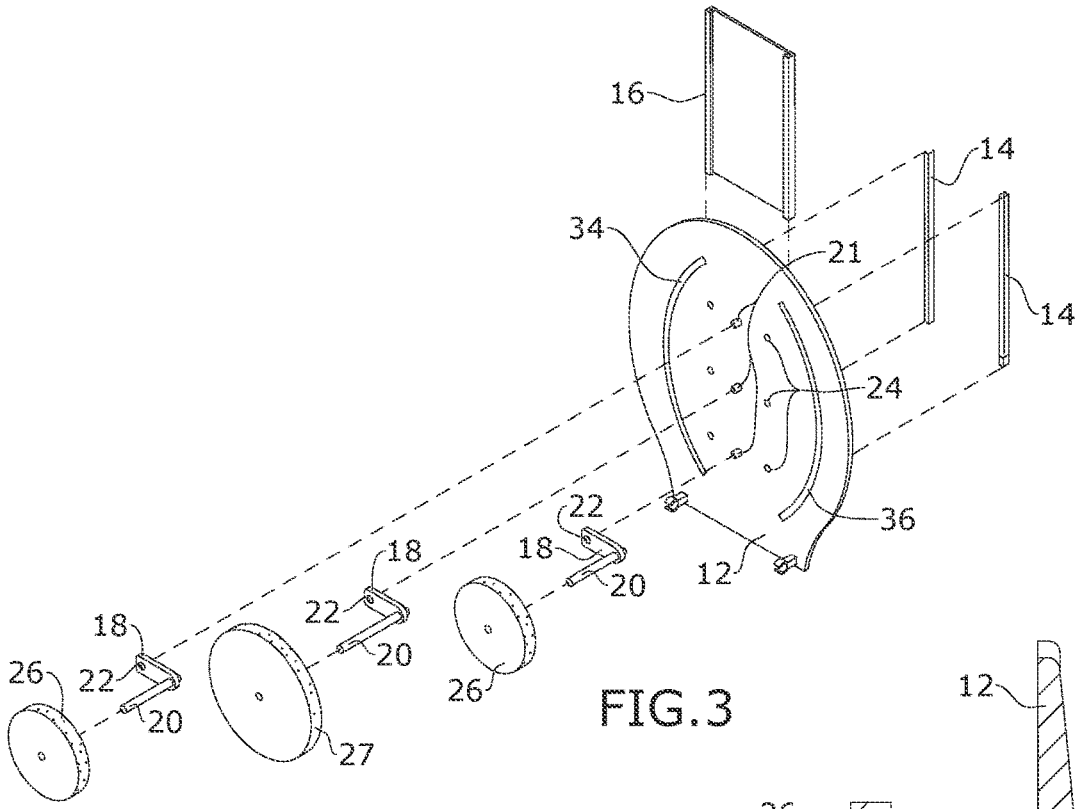
FIG. 3 is an exploded view thereof.

FIG. 3 details the attachment means of smaller cleaning brushes 26 and a larger cleaning brush 27 to an interior of the toilet lid 12. Detachable and rotatable connection pieces 18 are attached to the toilet lid 12 by anchors 21 and anchor holes 22. Connecting rods 20 extend from the detachable and rotatable connection pieces 18. Connecting rods 20 each attach to the smaller cleaning brushes 26. Another connecting rod 20 attaches to the larger cleaning brush 27. Sliding rails 14 are placed on an exterior of the toilet lid 12 and are connected to the toilet lid 12 by rod connection holes 24. The sliding rails 14 are configured to receive a removable cover 16.

Figure 4:
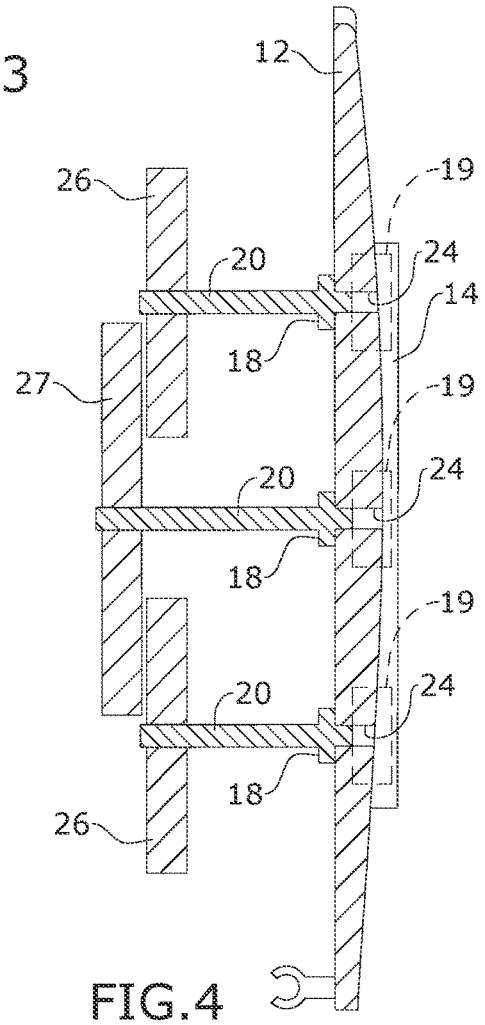
FIG. 4 is a section view taken on line 4-4 of FIG. 2.

FIG. 4 shows a removable cover 16 protecting motors 19. The motors 19 are operative to driving the smaller scrub brushes 26 and the larger scrub brush 27.

Figure 5:
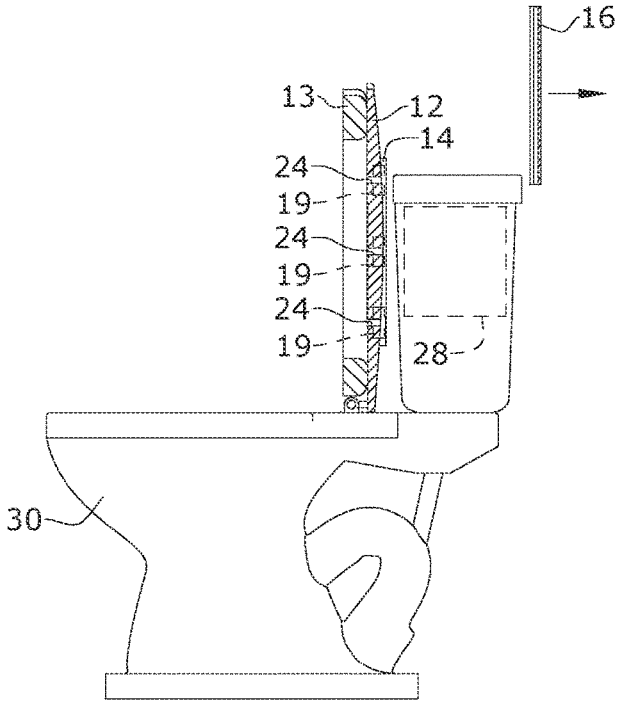
FIG. 5 is a side view of the automated toilet bowl cleaner according to an embodiment of the present invention with a brush unattached.
Figure 6:
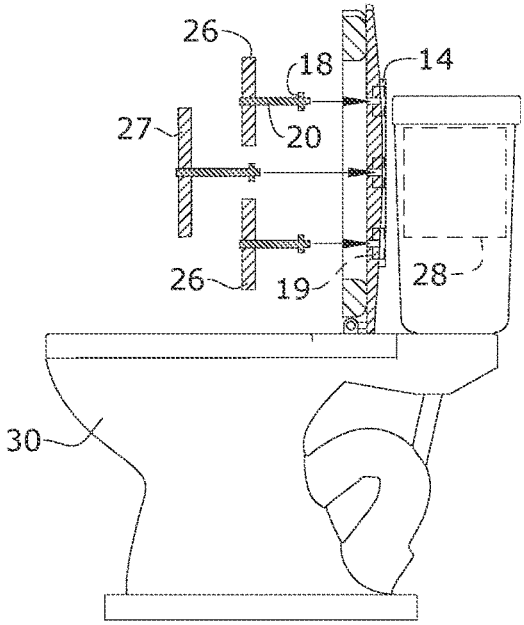
FIG. 6 is a side view thereof with the brush being attached.
Figure 7:
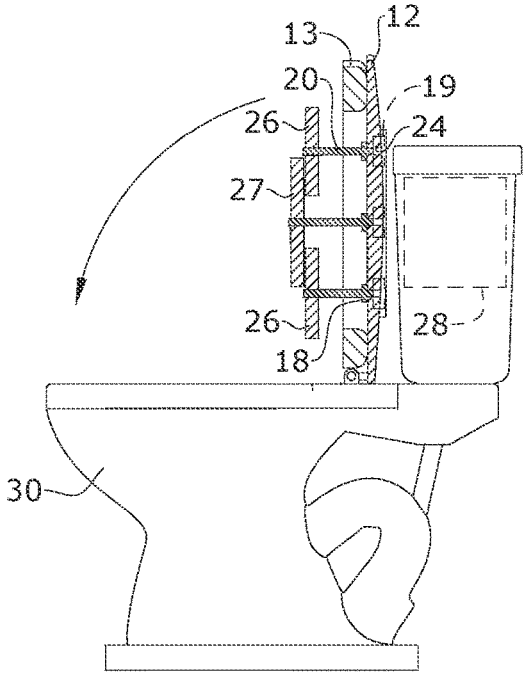
FIG. 7 is a side view thereof with the toilet bowl lid being closed.
Figure 8:
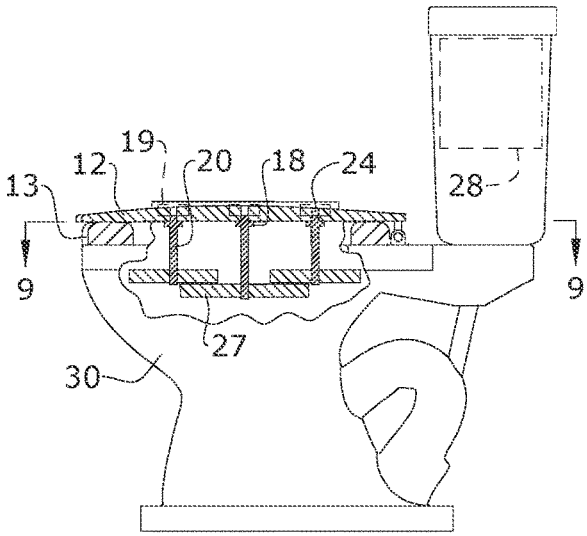
FIG. 8 is a side view thereof with the toilet bowl lid closed.

FIGS. 5-8 detail steps of using the automated toilet bowl cleaner 10 according to an embodiment of the present invention. FIG. 5 shows the sliding removable cover 16 removed, and the smaller scrubbing brushes 26 and larger scrubbing brush 27 unattached. FIG. 6 shows the smaller scrubbing brushes 26 and the larger scrubbing brush 27 being attached to the toilet lid 12. Once attached, the toilet lid 12 may be closed as shown in FIGS. 7 and 8.

Figure 9:
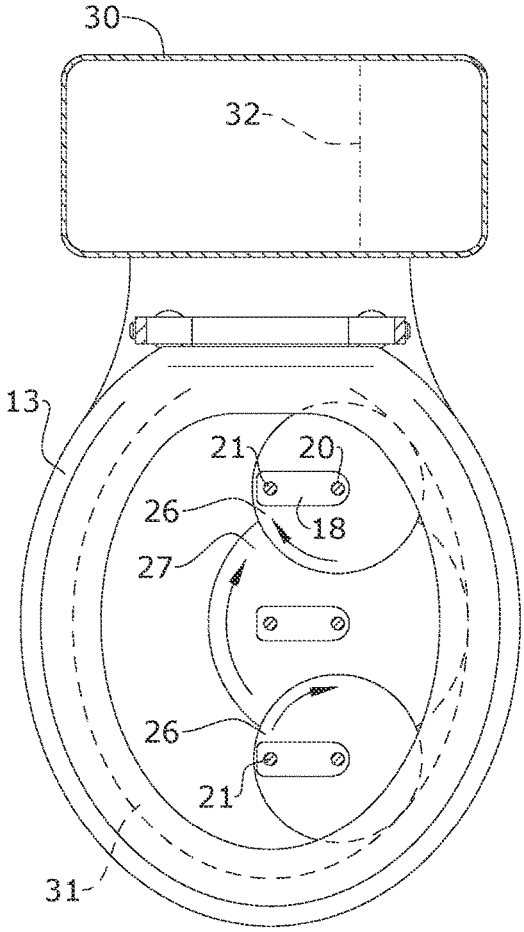
FIG. 9 is a section view taken on line 9-9 of FIG. 8.
Figure 10:
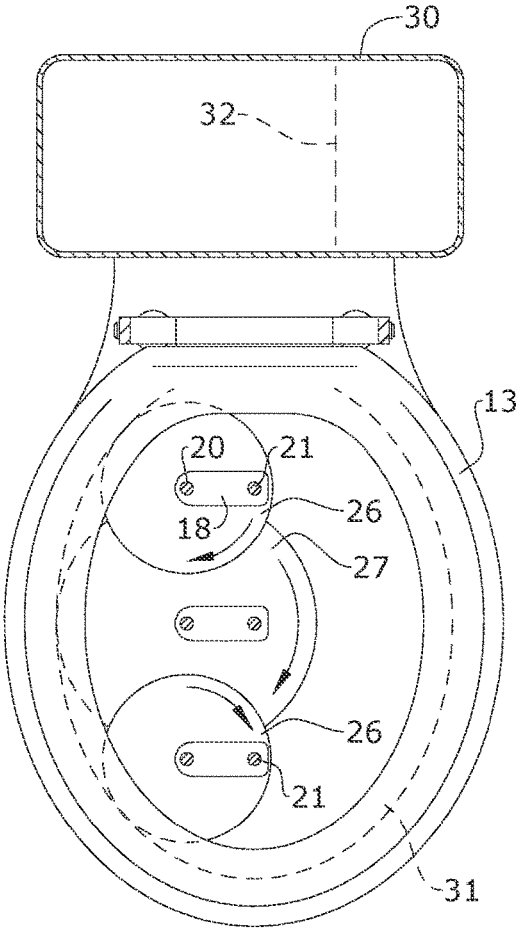
FIG. 10 is a top view thereof showing the brushes in a different location.
Figure 11:
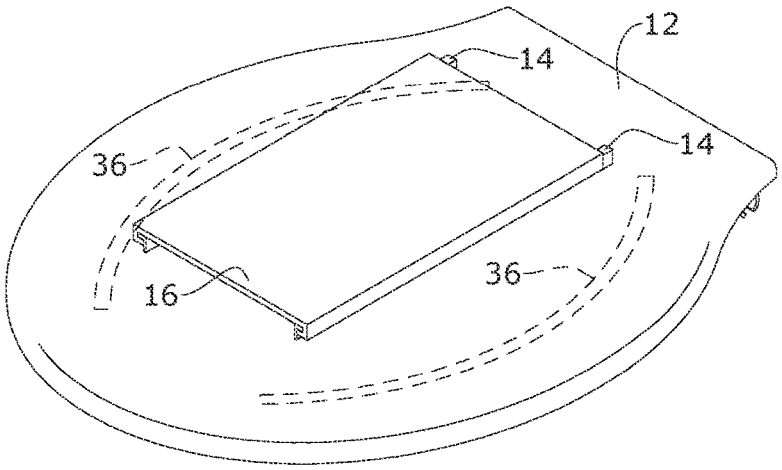
FIG. 11 is a top perspective view of the toilet bowl lid thereof.

FIGS. 9 and 10 depict a motion of the scrubbing brushes 26, 27 when cleaning a toilet bowl 31. The scrubbing brushes 26, 27 are rotated and driven by the motor 19. While unattached and not in use, the scrubbing brushes 26, 27 may be stored in an internal storage tank 32.

Figure 12:
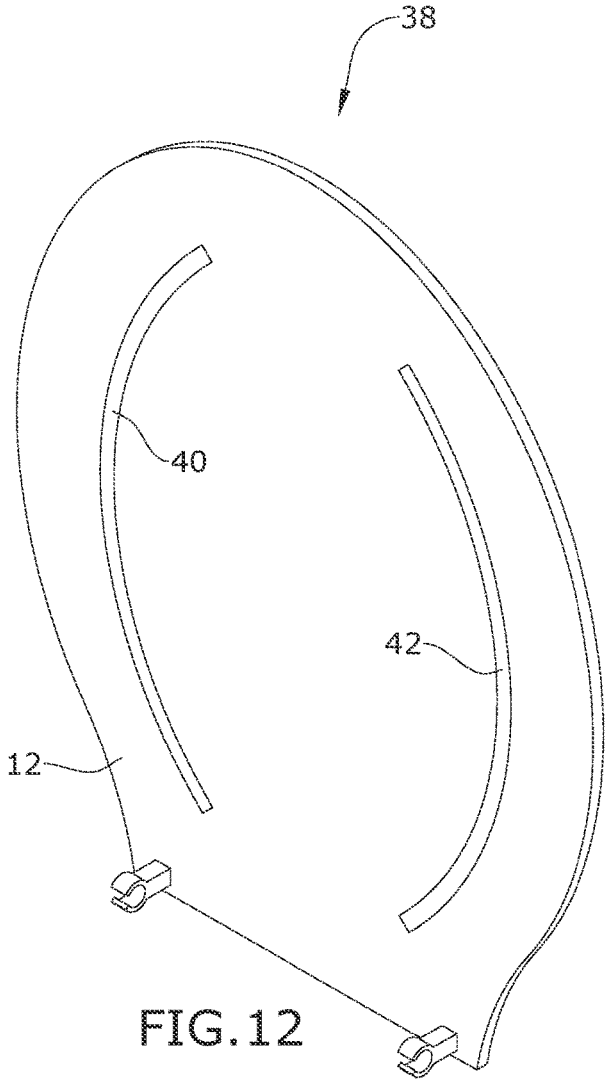
FIG. 12 is a perspective view of second embodiment of the present invention.

FIG. 12 depicts a second embodiment of a toilet bowl lid 38 according to an embodiment of the present invention. A second embodiment of a left brush guide 40 and a second embodiment of a right brush guide 42 are adapted to receive a standard toilet brush (not pictured), such as a standard toilet brush that may be purchased at a grocery or hardware store. Alternatively, a toilet brush specially adapted to the present invention may be utilized. The second embodiment of the toilet bowl lid 38 houses at least one motor which rotates standard toilet brushes releasably secured into the second embodiments of the brush guides 40, 42. The at least one motor may also cause the standard toilet brushes to horizontally traverse the second embodiments of the brush guides 40, 42 while rotating and scrubbing the toilet bowl 31.

Figure 13:
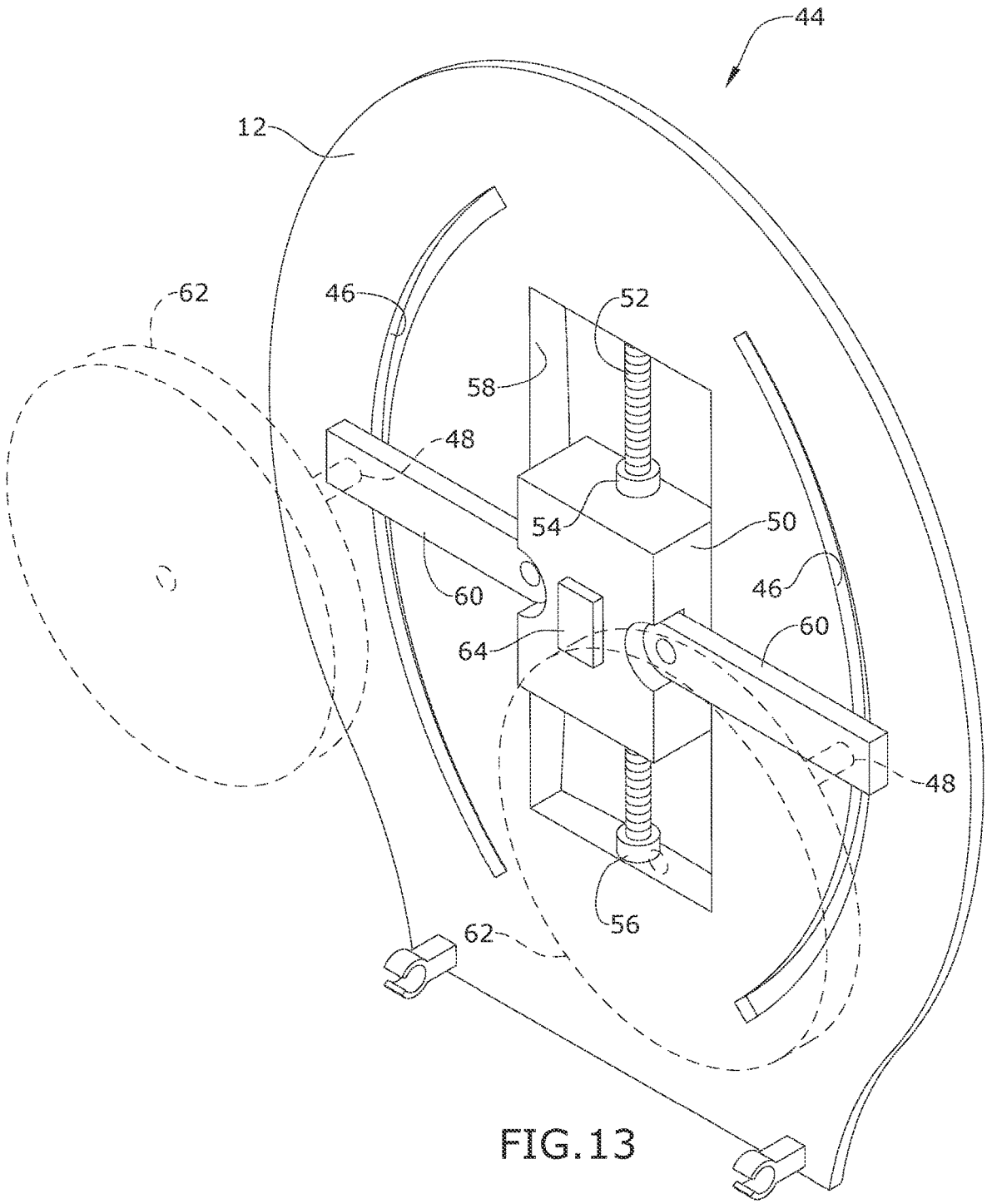
FIG. 13 is a perspective view of a third embodiment of the present invention.

FIG. 13 is a third embodiment of a toilet bowl lid 44 according to an embodiment of the present invention. A third embodiment of a left brush guide 46 and a third embodiment of a right brush guide 47 accommodate drive brush shafts 60. The drive brush shafts 60 are attached scrubbing brushes 62 by releasably secured connection rods 48. The releasably secured connection rod 48 enables a user to easily remove or attach scrubbing brushes 62 to the drive brush shafts 60.

As a drive motor 50 traverses a travel shaft 52, drive brush shafts 60 traverse the third embodiments of the brush guides 46, 47 causing the scrub brushes 62 to rotate and scrub the toilet bowl 31.

The drive motor 50 is operated by a power button 64. The drive motor 50 travels across a travel shaft 52. At least one bushing 56 may be attached to the travel shaft 52. A stopper 54 prevents the damage to the drive motor 50 when the drive motor traverses the travel shaft 52. The drive motor 50 may reverse direction when reaching the stopper 54, enabling a continuous cleaning.

Figure 14:
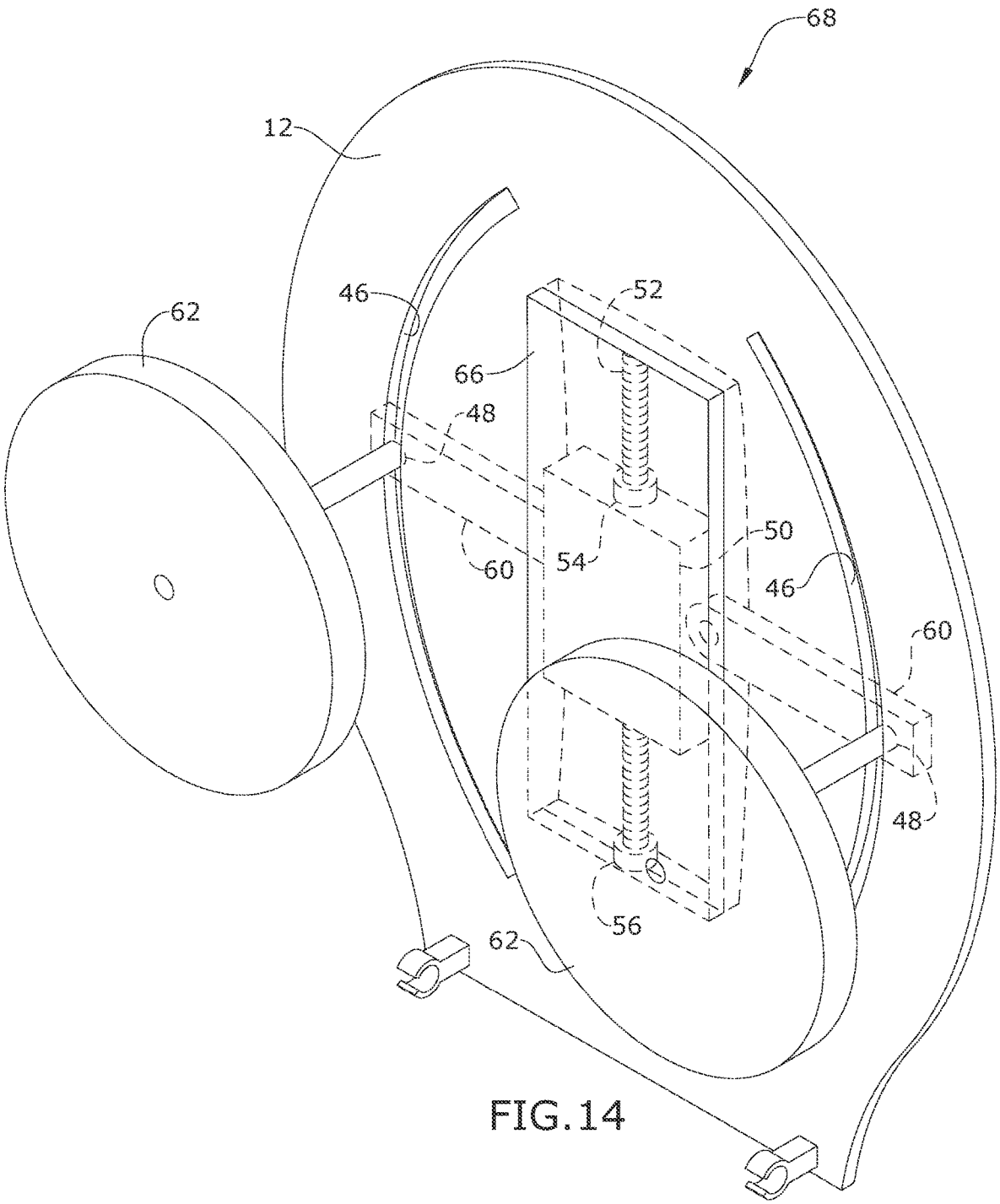
FIG. 14 is a is a perspective view of a fourth embodiment of the present invention.
Figure 15:
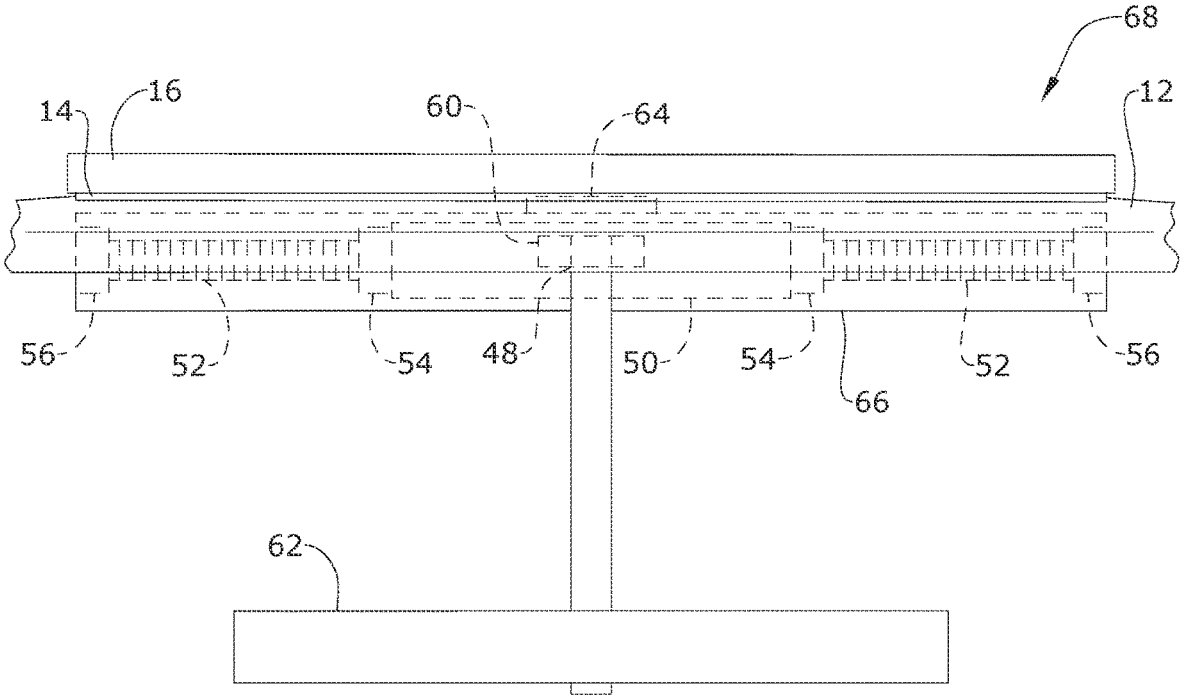
FIG. 15 is a side view thereof.

FIGS. 14 and 15 show a fourth embodiment of the toilet bowl lid 68 according to an embodiment of the present invention. The travel shaft 52, drive brush shafts 60, stopper 54, drive motor 50, and at least one bushing 56 are concealed by a bottom face of the toilet lid 12. Said concealed parts are accessible by the removable cover 16 on a top face of the toilet lid 12 as best seen in FIG. 15.

It should be understood, of course, that the foregoing relates to exemplary embodiments of the invention and that modifications may be made without departing from the spirit and scope of the invention as set forth in the following claims.

What is claimed is:

1. A toilet bowl lid for cleaning a toilet comprising:

a drive shaft vertically traversing an interior face of the toilet bowl lid;

a drive motor secured to the drive shaft wherein the drive motor may vertically travel the drive shaft;

a first drive brush shaft attached to the drive motor and a second drive brush shaft attached to the drive motor;

the first drive brush shaft configured to vertically traverse a left brush guide;

the second drive brush shaft configured to vertically traverse a right brush guide;

a left scrub brush releasably secured to the first drive brush shaft; and a right scrub brush releasably secured to the second drive brush shaft;

wherein the drive motor simultaneously rotates the first scrub brush and the second scrub brush while simultaneously causing the first drive brush shaft to traverse the left brush guide and the second drive brush shaft to traverse the right brush guide.

2. The toilet bowl lid of claim 1, further comprising a removable slide cover on an exterior face of the toilet bowl lid.

3. The toilet bowl lid of claim 1, further comprising a power button on the drive motor.

* * * * *